US009022369B2

(12) United States Patent
DeMoss et al.

(10) Patent No.: US 9,022,369 B2
(45) Date of Patent: May 5, 2015

(54) REVERSE COIL HEAD COILS AND INNERSPRINGS

(75) Inventors: Larry DeMoss, Greensboro, NC (US); James A. Beamon, Jamestown, NC (US); Brian M. Manuszak, Thomasville, NC (US); Herman F. Fisher, Wilkes-Barre, PA (US); Joseph Truskolasky, Mahanoy, PA (US); David J. Pleiman, Peyton, CO (US); Dan Olsen, Calhan, CO (US); Randy Sizemore, Rensselaer, IN (US)

(73) Assignee: Sealy Technology, LLC, Trinity, NC (US)

( * ) Notice: Subject to any disclaimer, the term of this patent is extended or adjusted under 35 U.S.C. 154(b) by 344 days.

(21) Appl. No.: 13/010,525

(22) Filed: Jan. 20, 2011

(65) Prior Publication Data

US 2012/0186026 A1 Jul. 26, 2012

(51) Int. Cl.

| | |
|---|---|
| ***F16F 1/06*** | (2006.01) |
| ***A47C 27/07*** | (2006.01) |
| ***A47C 23/043*** | (2006.01) |
| ***A47C 27/06*** | (2006.01) |
| ***A47C 23/053*** | (2006.01) |

(52) U.S. Cl.

CPC ..... *A47C 27/07* (2013.01); *A47C 23/0438* (2013.01); *A47C 27/065* (2013.01); *A47C 23/0507* (2013.01)

(58) Field of Classification Search

USPC ..... 267/166, 91, 103, 166.1, 167, 180; 5/716, 248, 251, 256, 269, 655.7

See application file for complete search history.

(56) References Cited

U.S. PATENT DOCUMENTS

| | | | | |
|---|---|---|---|---|
| 4,609,186 | A | 9/1986 | Thoenen | |
| 4,726,572 | A | 2/1988 | Flesher et al. | |
| 5,713,088 | A | 2/1998 | Wagner et al. | |
| 6,354,577 | B1 | 3/2002 | Quintile et al. | |
| 7,044,454 | B2 | 5/2006 | Colman et al. | |
| 7,063,309 | B2 | 6/2006 | Colman | |
| D527,932 | S | 9/2006 | Eigenmann et al. | |
| D528,329 | S | 9/2006 | Eigenmann et al. | |
| D528,330 | S | 9/2006 | Eigenmann et al. | |
| D528,833 | S | 9/2006 | Eigenmann et al. | |
| D530,120 | S | 10/2006 | Eigenmann et al. | |
| D531,436 | S | 11/2006 | Eigenmann et al. | |
| 7,178,187 | B2 | 2/2007 | Barman et al. | |
| 7,386,897 | B2 | 6/2008 | Eigenmann et al. | |
| 7,404,223 | B2 | 7/2008 | Manuszak et al. | |
| 7,578,016 | B1 * | 8/2009 | McCraw | 5/716 |
| D651,828 | S | 1/2012 | DeMoss et al. | |
| D652,234 | S | 1/2012 | DeMoss | |
| D652,235 | S | 1/2012 | DeMoss | |
| 2004/0046297 | A1 | 3/2004 | DeMoss et al. | |

(Continued)

OTHER PUBLICATIONS

U.S. Appl. No. 61/435,062, DeMoss.

(Continued)

*Primary Examiner* — Pamela Rodriguez

(74) *Attorney, Agent, or Firm* — J. Mark Wilkinson

(57) ABSTRACT

A reverse coil head coil and innerspring has a generally cylindrical and helical wire form coil body and opposing coil ends which terminate on opposite sides of a reference plane that passes through the coil body. The reverse coil head coils are interconnected in a matrix to form an innerspring wherein only one terminal end of each coil is located at a perimeter of the innerspring. Variations in the number and pitch of helical turns of the coil body are also disclosed.

13 Claims, 5 Drawing Sheets

(56) References Cited

U.S. PATENT DOCUMENTS

| | | | | |
|---|---|---|---|---|
| 2007/0169275 | A1* | 7/2007 | Manuszak et al. | 5/716 |
| 2008/0115287 | A1 | 5/2008 | Eigenmann et al. | |
| 2010/0299839 | A1 | 12/2010 | Eigenmann | |
| 2011/0107523 | A1* | 5/2011 | Moret et al. | 5/718 |

OTHER PUBLICATIONS

Leggett & Platt Verticoil Edge brochure http://www.beddingcomponents.com/verticoil-edge-brochure/.

Patent Cooperation Treaty: International Preliminary Report on Patentability; Jul. 23, 2013: 9 pgs.

* cited by examiner

REVERSE COIL HEAD COILS AND INNERSPRINGS

RELATED APPLICATIONS

There are no applications related to this application.

FIELD OF THE INVENTION

The present invention is in the general field of reflexive support structures such as mattresses and seating, and more specifically in the field of individual spring components and spring assemblies which are internal to reflexive support structures.

BACKGROUND OF THE INVENTION

Mattress innersprings, made of matrices or arrays of a plurality of wire form springs or coils, have long been used as the reflexive core of a mattress, which is covered with padding and upholstery to complete a mattress. Innersprings made of formed steel wire are mass produced by machinery which forms the coils from steel wire stock and interconnects or laces the coils together in the matrix array. With such machinery, design attributes of innersprings can be selected and modified, including the gauge of the wire, the coil design or combinations of designs, coil orientation relative to adjacent coils in the matrix array, and the manner of interconnection or lacing of the coils.

There are general design considerations of manufacture and comfort which underlie the design of any mattress. For example, considerable effort has been devoted in the industry to the development of coils with end or terminal convolutions which facilitate the interengagement of the spring coils. For example, end convolutions have been developed having offset portions formed thereon which include a straight portion, such as those disclosed in U.S. Pat. Nos. 4,726,572 and 7,404,223. Offset portions enable the spring ends to be secured along a substantial length of the straight portion which will engage with more helical spirals of a lacing wire, and thereby provide more stability for the individual coils. Improved interengagement of the coils of an innerspring without interference and lateral stability is always being sought. Also, ease of manufacture and minimization of costs are always a concern.

An example of a coil which is depicted as having terminal ends which terminate on opposite sides of the coil body is shown in U.S. Pat. No. 7,386,897. As described therein, the coil is used in an innerspring which is constructed with borderwires which encircle the top and bottom support surfaces of the innerspring. As described, the borderwires are necessary for the assembly of an innerspring with this type of coil. The disclosed coils are made of high tensile strength wire to minimize the number of convolutions required to maintain performance characteristics. The high tensile strength wire may minimize the amount of material used but high increases material and handling costs and it also introduces a greater amount of wear on the wire forming equipment.

SUMMARY OF THE INVENTION

In one embodiment a reverse coil head coil is described as having a generally helical coil body with a plurality of turns of wire, a first end turn which is contiguous with an upper region of the coil body and lying in a plane which is generally perpendicular to the axis of the coil body, the first end turn being non-helical and a second end turn which is contiguous with a lower region of the coil body and lying in a plane which is generally perpendicular to the axis of the coil body, the second end turn being non-helical. A connecting segment is located between the first end turn and the coil body in the form of a gradient arm extending in the same plane as the terminal convolution. The first and second end turns each have a free end, both free ends being located on the same side of the axis of the coil body.

In another embodiment the reverse coil head coil is described as having a generally cylindrical body with three or more helical turns of wire which form a helical path about a longitudinal axis of the coil, the coil body terminating at opposed axial ends, each of the opposed axial ends having an offset and a free end, the free ends terminating on the same side of the longitudinal axis of the coil. The pitch and diameter of a helical turn located at the center of the coil body is less than the pitch and diameter of the other helical turns. A gradient arm is located between one of the opposed axial ends of the coil body and the coil body.

In another embodiment, a mattress innerspring is described comprising a plurality of wire coils interconnected in an array, each wire coil comprising a coil body with a terminal convolution at opposing ends and a plurality of convolutions therebetween, each terminal convolution being in a plane which is generally perpendicular to a longitudinal axis of the coil body and having a free end and at least one linear segment. A gradient arm is located between one terminal convolution and one of the plurality of convolutions. The free or terminal ends of the ends of the coil are on the same side of the coil body. Although this coil design works well in practice when laced together in an innerspring, because the terminal wire ends of the coil ends are one the same side of the coil body or axially aligned, each coil has a tendency or bias to lean toward the terminal ends when compressed. This bias is magnified in an innerspring made with these coils giving the innerspring a tendency to lean, which must be controlled or countered with the surrounding components of the mattress construction.

DETAILED DESCRIPTION OF PREFERRED AND ALTERNATE EMBODIMENTS

Figure 1:
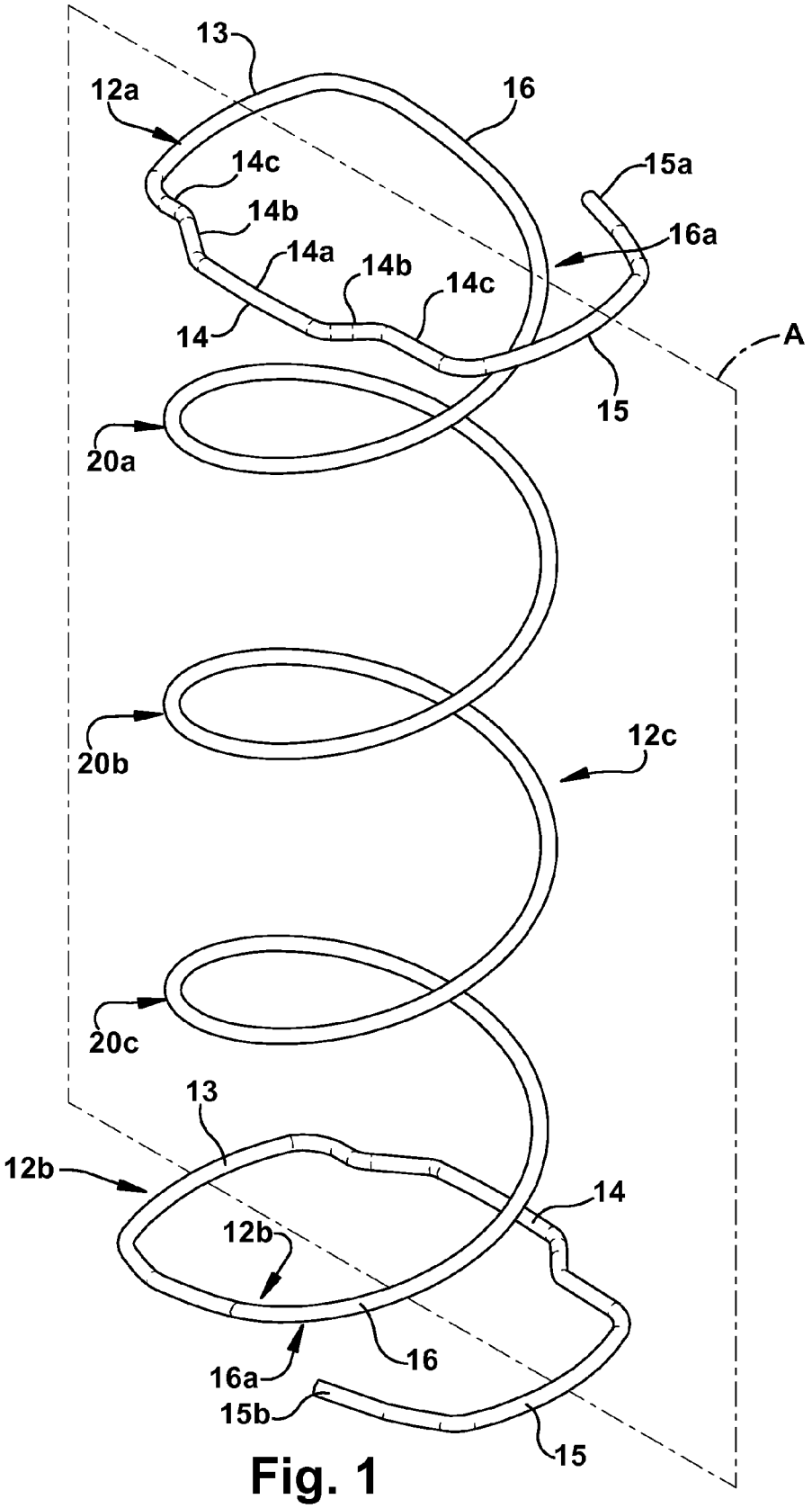
FIG. 1 is a perspective view of a Reverse Coil Head Coil according to the present invention.
Figure 2:
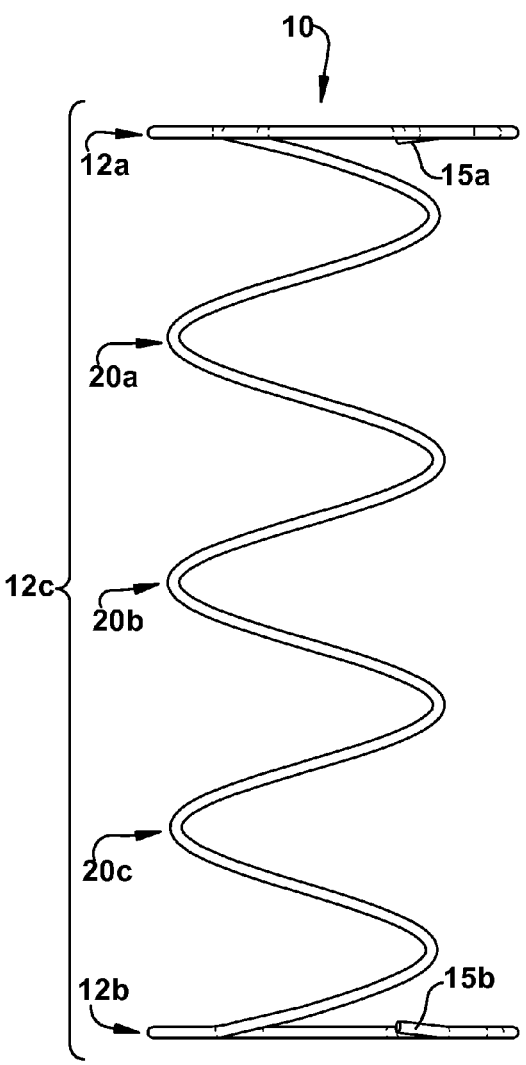
FIG. 2 is a side view of the Reverse Coil Head Coil of FIG. 1.
Figure 3:
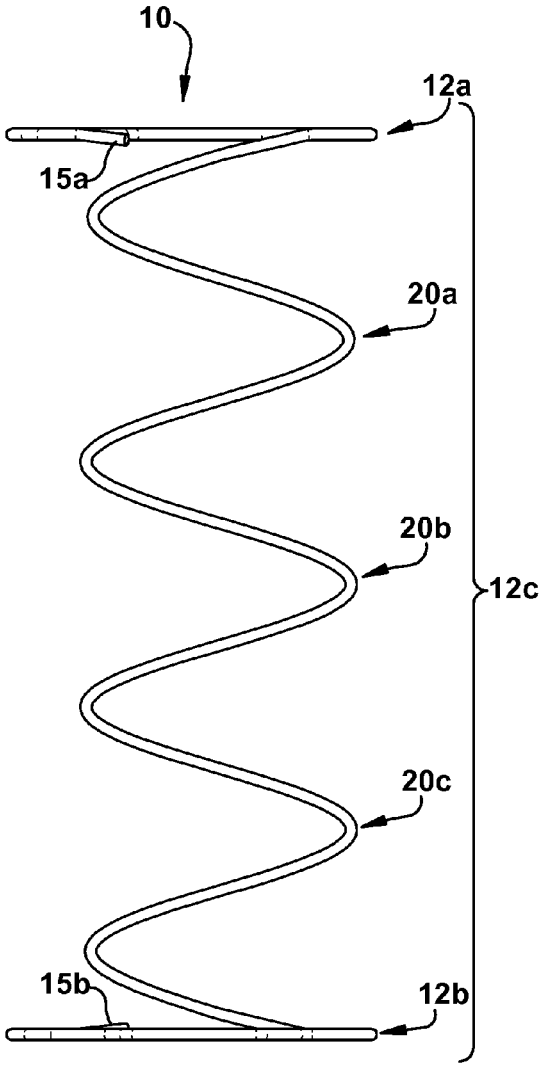
FIG. 3 is the opposite side view of the Reverse Coil Head Coil of FIG. 2.
Figure 4:
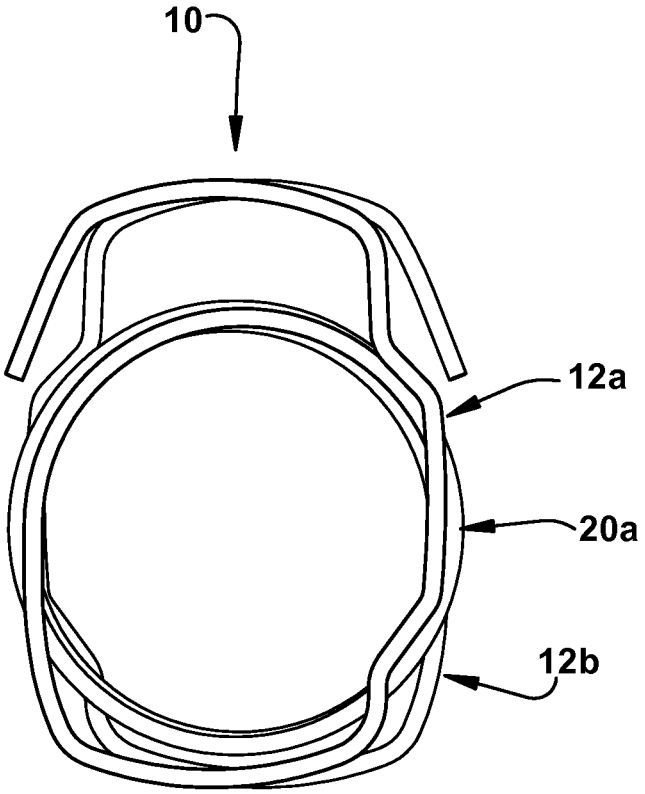
FIG. 4 is a top view of the Reverse Coil Head Coil of FIG. 1.

As shown in the Figures, a reverse coil head coil (hereinafter referred to as "RCH coil" or "coil") of the present disclosure and related inventions is indicated in its entirety at reference numeral 10. The RCH coil 10 has a generally helical and cylindrical body 12*c* formed by a plurality of generally helical turns, such as 20*a*, 20*b* and 20*c*. The coil body 12*c* is connected to respective coil ends 12*a*, 12*b*. The coil ends 12*a*, 12*b* can be in any form, and have one or more segments which are generally in the same plane and generally perpendicular to an axis of the coil body. In the embodiment shown in FIG. 1, each coil end 12*a*, 12*b* has multiple segments which may be linear, curved, and extend laterally inside or outside of the extent of the coil body. Segments of the coil ends may be linear or curvilinear and may be located within or outside of the diameter of the helical coil body. When formed to extend partially or entirely outside of the diameter of the coil body 12*c* these segments of the coil ends are referred to as "offsets", which facilitate inter-engagement between the coils, such as for example by a helical lacing wire which wraps around the offsets of adjacent coils to lace them together, as shown for example in FIG. 5. As noted, in the coils of the present disclosure, the opposing coil ends are out of phase and generally diametrically opposed or 180 degrees out of phase with respect to a reference plane A through the body of the coil, as shown in FIG. 1.

The coil body 12*c* has a longitudinal axis which runs the length of the coil at the radial center of each of the helical turns of the coil. The coil body is contiguous with a first coil end, generally indicated at 12*a*, and a second coil end, generally indicated at 12*b*. The designations "first coil end" and "second coil end" are for identification and reference only and do not otherwise define the locations or orientations of the coil ends. Accordingly, either the first coil end 12*a* or the second coil end 12*b* may alternatively be referred to herein as a "coil end". Either of the coil ends 12*a*, 12*b* may serve as the support end of the coil in an innerspring in a one-sided or two-sided mattress. The two coil ends 12*a*, 12*b* do not have to be identically configured. The coil ends 12*a*, 12*b* lie generally in respective planes generally perpendicular to the longitudinal axis of the coil body and form the generally planar support or bottom surfaces of an innerspring. The coil, ends 12*a*, 12*b* can be of identical form or dissimilar forms and may have a generally larger diameter than the coil body or extend laterally beyond the coil body.

Figure 5:
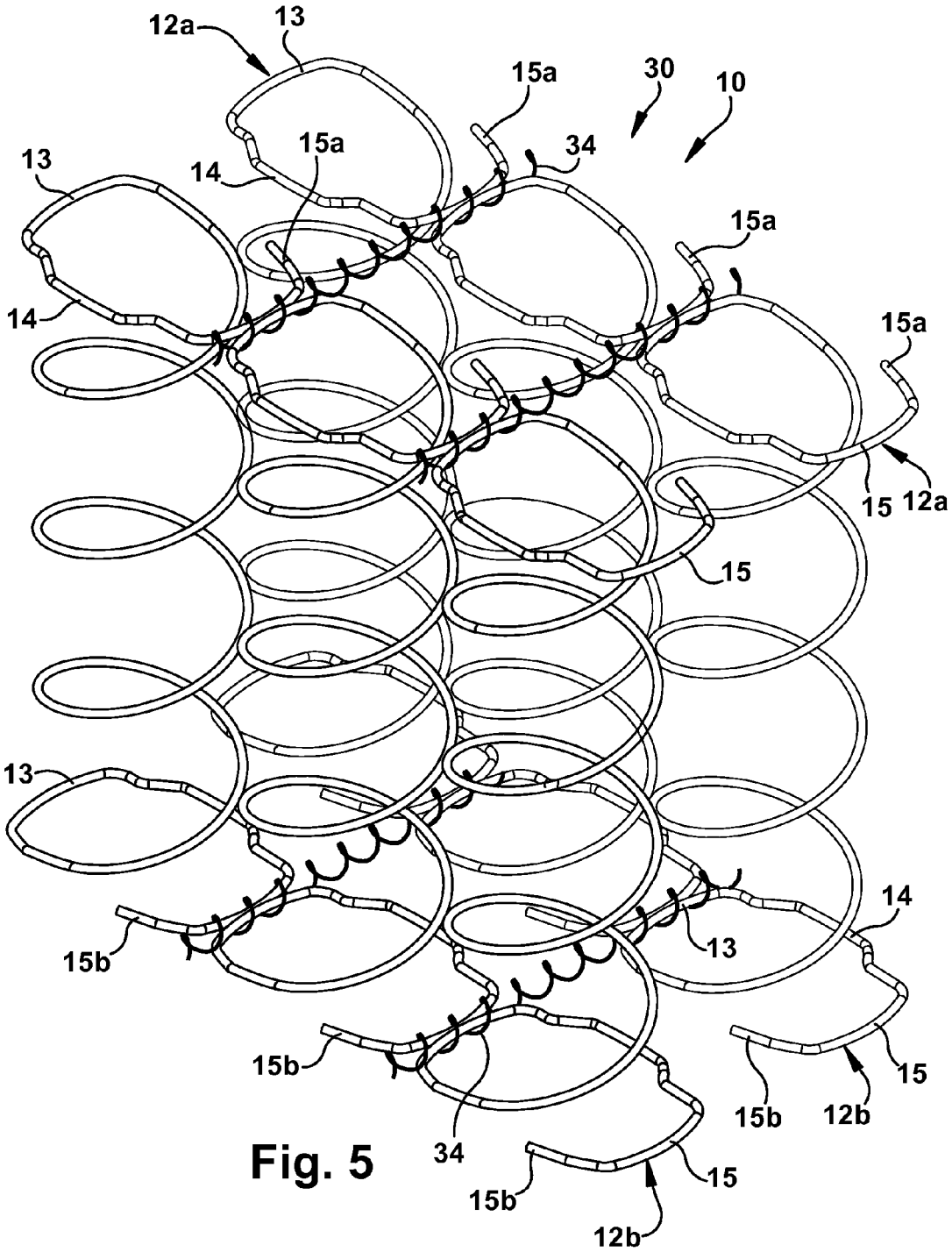
FIG. 5 is a perspective of an innerspring assembled with the Reverse Coil Head Coil of FIG. 1.

The coil ends 12*a*, 12*b* are each formed in an open end offset configuration that includes three offset portions and an open or terminal end. Terminal ends 15*a* and 15*b* (also referred to herein as "free ends") are left open with respect to the coil, that is they do not return to the coil body or coil end and are not tied or knotted thereto. As shown in FIG. 1, on each coil end 12*a*, 12*b*, there is a first offset 13 which is generally linear connected to a second offset 14 which is also generally linear but which may also include multiple connecting or transition or stepped segments 14*a*, 14*b* and 14*c*, and a terminal offset 15, from which the respective terminal ends 15*a*, 15*b* extend. Each terminal offset 15 has a free or terminal end 15*a* which is turned to extend generally perpendicularly from the terminal offset 15, or generally parallel to second offset 14. The terminal end 15*a* preferably does not extend past the center of the coil to avoid interference with the first convolution of the coil body and prevent a clicking sound or other noise relating to interference with the same or adjacent coils. Preferably, the offset portions are not in the generally helical form of the coil body 12*c*. The offsets 13, 14 and 15 are approximately in the same plane, which is perpendicular to an axis of the coil body 12*c*. The coil ends 12*a* and 12*b* of this general configuration are advantageous for allowing the coils to be closely arranged in an innerspring array than coils with circular ends, and provide a generally linear path for lacing wires that run between and interconnect the coils, as shown in FIG. 5. The coils are positioned in the innerspring matrix such that the first offsets 13 overlap terminal offsets 15 of the adjacent coils. As further shown in FIG. 5, the overlapped offsets are connected together by a lacing wire 34 to interconnect entire rows of adjacent coils to form an innerspring 30. The connected offsets 13 and 15 allow for independent movement of each coil and provide a hinge action at the lacing wire interconnection.

The first offset 13 extends from a transition or connecting segment 16 which connects the coil ends 12*a*, 12*b* to the coil body 12*c*. The integral connection of the connecting segment 16 and the coil body 12*c* is at a transition angle from the helical coil body 12*c* which forms a gradient arm 16*a*, in the general region indicated, which alters the spring rate of the coil under different types of loads. The compression of the coil, and thus the firmness of the coil, can be adjusted within limits by varying the length and angle of the gradient arm 16*a* relative to the coil body 12*c* and coil end 12*a*, 12*b*. The gradient arm 16 adds extra support when a load is applied to the coil, as described in U.S. Pat. No. 4,726,572, which is incorporated herein by reference.

A preferred embodiment of the RCH coils of the present disclosure is made from a single piece of wire which is first given a spiral shape and then formed with the desired coil ends or terminal convolutions. In a preferred embodiment, the wire stock is for example, such as 14.25 gauge wire with a tensile strength between 235,000 and 255,000 psi. The coil has an approximate overall axial length in a range of about 6.0 inches to 6.5 inches with approximately 4.75 turns or revolutions. The center convolution 20*b* has a slightly smaller pitch and diameter measurements than the two convolutions 20*a*, 20*c* adjacent to center. The center convolution 20*b* has both a pitch and a diameter of approximately 44 mm. The two convolutions 20*a*, 20*c* adjacent to the center convolution each have a pitch and diameter of approximately 48 mm. The approximate length of each free end 15*b* is approximately 15 mm.

FIG. 5 illustrates a portion of an innerspring 30 in which a plurality of RCH coils 10 are connected together by lacing wires 34 are engaged with the respective ends 12*a* and 12*b* of the coils, and more particularly engaged with the first offsets 13 of the coils ends and the terminal offsets 15 of the coils ends of adjacent coils, and vice versa, and wherein the respective terminal ends 15*a* and 15*b* are consistently oriented within the innerspring. In this view it is apparent that the coil ends 15*a* are commonly oriented toward one side of the innerspring, and coil ends 15*b* are commonly located toward an opposite side of the innerspring and generally diametrically opposed to coil ends 15*a*. As further shown in FIG. 5, a perimeter of the mattress innerspring 30 is formed by the reverse coil head coils located at the perimeter or sides of the innerspring (right and left sides and the head and foot end sides), with the terminal ends 15*b* of the second coil ends 12*b* located at the perimeter of one side of the innerspring 30 and more particularly at an edge of the perimeter of the innerspring 30, and the terminal ends 15*a* of the first coil ends 12*a* located inboard of the perimeter of one side of the innerspring 30, wherein the perimeter of the innerspring 30 is defined by the outmost region of the coils along the sides of the innerspring 30. At the opposite side of the innerspring perimeter, the terminal ends 15*a* of the first coil ends 12*a* are located at the perimeter of the innerspring, and the terminal ends 15*b* of second coil ends 12*b* are located inboard of the perimeter. For the other two sides of the perimeter of the innerspring, one is formed by terminal offsets 15, and the other by first offsets 13. Of course these orientations can be reversed by inversion of the innerspring 30. In the example shown in FIG. 5, the terminal ends 15*b* are located at one longitudinal perimeter of the innerspring, and terminal ends 15*a* are located at an opposite longitudinal perimeter of the innerspring, and terminal offsets 15 are located at one transverse perimeter of the innerspring (for example the head or foot end of a mattress innerspring) and first offsets 13 are located at an opposite transverse perimeter of the innerspring.

Figure 6:
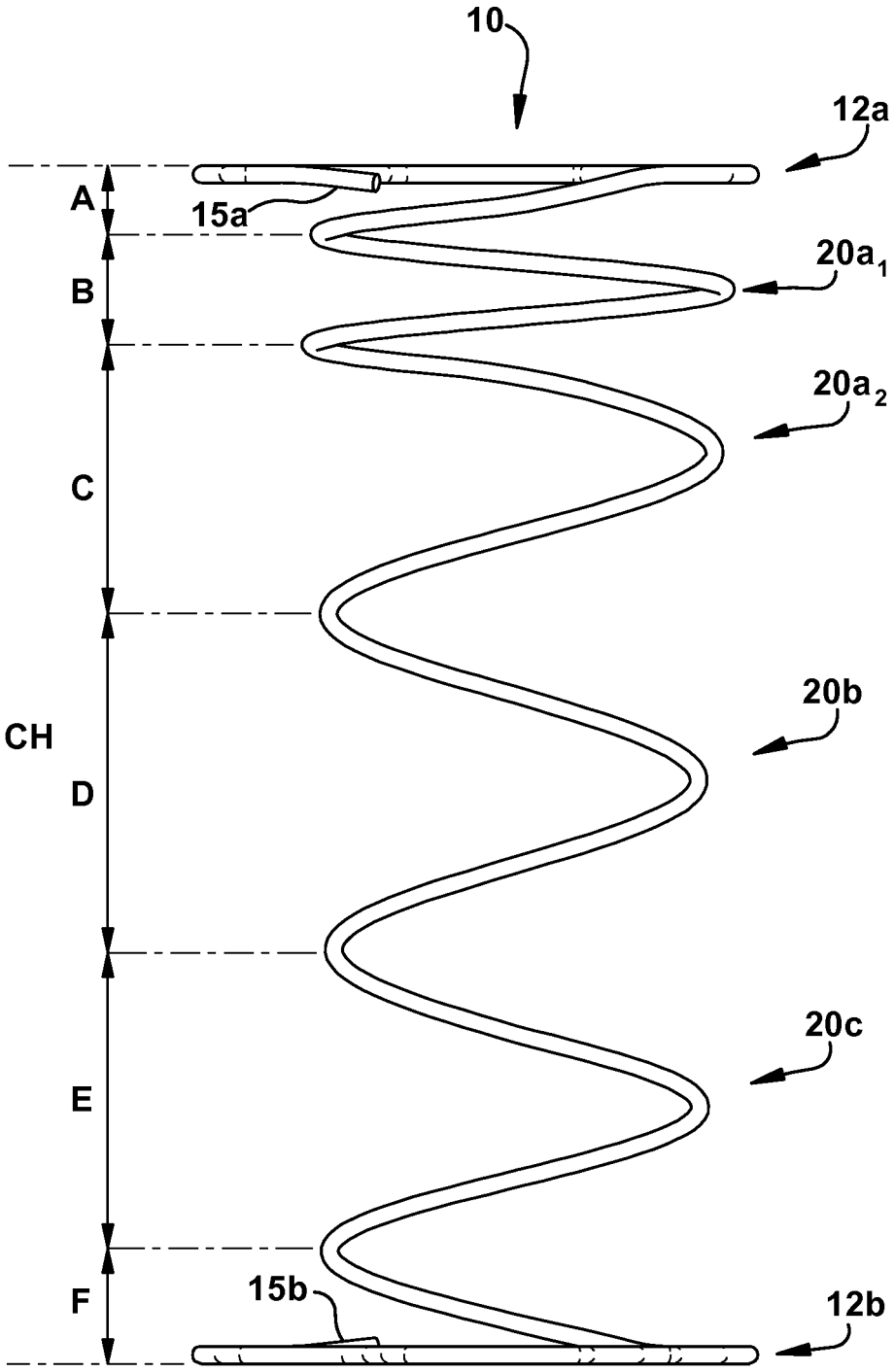
FIG. 6 is an elevation of an alternate embodiment of a Reverse Coil Head Coil of the present disclosure.

FIG. 6 illustrates an alternate embodiment of an RCH coil 10 of the present disclosure wherein the coil body 12*c* has pitch angles or vertical spacing between the helical turns of the coil. Approximate exemplary dimensions may be, for example: pitch spacing A may be 20 mm, pitch B 15 mm, pitch C 37 mm, pitch D 39 mm, pitch E 37 mm and pitch F 15 mm, for an approximate total coil height CH of 160 mm-165 mm. The smaller pitch dimensions create a smaller spring rate which provides the coil with a soft initial feel or easier compression at that end of the coil which is graduated to a higher spring rate toward the middle range of the coil body and to the base. The coil bodies 12*c* of the RCH coils can be made the same as or similar to the coils disclosed in the commonly assigned U.S. Pat. No. 7,178,187 which is incorporated herein by reference. The described axial alignment properties of the RCH coil 10 work equally well with these types of asymmetric coil designs.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A mattress innerspring comprising a plurality of interconnected reverse coil head coils, each reverse coil head coil having:

a generally helical coil body with a plurality of generally helical turns of wire;

a first coil end contiguous with a first end of the coil body and substantially lying in a plane which is generally perpendicular to an axis of the coil body;

a second coil end contiguous with a second end of the coil body and substantially lying in a plane which is generally perpendicular to the axis of the coil body;

the first coil end having an offset which is located on a first side of a reference plane which passes through the coil body, the offset of the first coil end having a stepped segment defined by first and second segments and a third segment located between the first and second segments and wherein the first and second segments are substantially coplanar with the third segment;

the second coil end having an offset which is located on a second side of the reference plane which passes through the coil body, the offset of the second coil end having a stepped segment defined by first and second segments and a third segment located between the first and second segments and wherein the first and second segments are substantially coplanar with the third segment;

the plurality of reverse coil head coils arranged in a matrix and wherein the axes of the coils are generally parallel and the first coil ends are generally co-planar and the second coil head ends are generally co-planar, the first coil ends of adjacent coils being laced together by a lacing wire, the lacing wire engaged with the offset of the first coil end of a coil and engaged with the offset of the first coil end of an adjacent coil, the first coil end having a terminal end extending from the offset of the first coil end, and the second coil ends of adjacent coils being laced together by a lacing wire, the lacing wire engaged with the offset of the second coil end of a coil and engaged with the offset of the second coil end of an adjacent coil, the second coil end having a terminal end extending from the offset of the second coil end.

2. The mattress innerspring of claim 1, wherein each of the reverse coil head coils has at least three turns in the coil body.

3. The mattress innerspring of claim 1 wherein a diameter of the first and second coil ends of the reverse coil head coils is in an approximate range of 43 mm to 55 mm.

4. The mattress innerspring of claim 1 reverse coil head coil of claim 1, wherein a diameter of a turn of the coil body of the reverse coil head coils located in a middle region of the coil body is approximately 44 mm.

5. The mattress innerspring of claim 1, wherein the reverse coil head coils are made of 14.25 gauge wire having a tensile strength between 235,000 and 255,000 psi.

6. A mattress innerspring comprising a plurality of interconnected reverse coil head coils, each of the reverse coil head coils comprising a generally cylindrical coil body with three or more helical turns of wire about a longitudinal axis of the coil body, the coil body terminating at opposite first and second coil ends;

each of the first and second coil ends having at least one offset and a free end, an offset of the first coil end located on a first side of a reference plane which passes through the body of the coil, the offset of the first coil end having a stepped segment defined by first and second segments and a third segment located between the first and second segments and wherein the first and second segments are substantially coplanar with the third segment, and an offset of the second coil end located on an opposite side of the reference plane which passes through the body of the coil, the offset of the second coil end having a stepped segment defined by first and second segments and a third segment located between the first and second segments and wherein the first and second segments are substantially coplanar with the third segment; and a pitch and diameter of at least one helical turn located in a middle region of the coil body being less than the pitch and diameter of other helical turns of the coil body which are relatively closer to the first or second coil ends.

7. The mattress innerspring of claim 6, wherein the helical turn of the reverse coil head coils located in the middle region of the coil body has a pitch in an approximate range of 38mm to 44 ram.

8. The mattress innerspring of claim 6, wherein a diameter of the first and second coil ends of the reverse coil head coils is in an approximate range of 48 mm to 52 mm.

9. The innerspring of claim 6, wherein the helical turn of the reverse coil head coils located in a middle region of the coil body has a diameter of approximately 44 mm.

10. The innerspring of claim 6, wherein a coil height of the reverse coil head coils in an uncompressed state is in an approximate range of 100 mm to 125 mm.

11. The innerspring of claim 6, wherein the coil body has at least four or more helical turns.

12. The innerspring of claim 6, wherein the free ends of the coil ends have a length of approximately 15 mm.

13. The innerspring of claim 6, wherein the first and second coil ends of the reverse coil head coils have a generally rectangular shape.

* * * * *